US010162310B2

(12) United States Patent
Dubois

(10) Patent No.: US 10,162,310 B2
(45) Date of Patent: Dec. 25, 2018

(54) METHOD OF FORMING A DECORATIVE SURFACE ON A MICROMECHANICAL TIMEPIECE PART AND SAID MICROMECHANICAL TIMEPIECE PART

(71) Applicant: Nivarox-FAR S.A., Le Locle (CH)

(72) Inventor: Philippe Dubois, Marin (CH)

(73) Assignee: Nivarox-FAR S.A., Le Locle (CH)

( * ) Notice: Subject to any disclaimer, the term of this patent is extended or adjusted under 35 U.S.C. 154(b) by 105 days.

(21) Appl. No.: 15/234,123

(22) Filed: Aug. 11, 2016

(65) Prior Publication Data

US 2017/0068221 A1 Mar. 9, 2017

(30) Foreign Application Priority Data

Sep. 8, 2015 (EP) ..... 15184187

(51) Int. Cl.
*G04B 13/00* (2006.01)
*G04B 13/02* (2006.01)
(Continued)

(52) U.S. Cl.
CPC ..... *G04B 45/0076* (2013.01); *C23C 28/345* (2013.01); *C23C 28/3455* (2013.01);
(Continued)

(58) Field of Classification Search
CPC ..... G04B 13/00; G04B 13/02; G04B 13/022; G04B 13/026; G04B 15/14; G04B 31/00;
(Continued)

(56) References Cited

U.S. PATENT DOCUMENTS 4,599,251 A 7/1986 Feller
4,725,511 A * 2/1988 Reber ..... A44C 27/00 29/896.32

(Continued)

FOREIGN PATENT DOCUMENTS

EP 1 722 281 A1 11/2006

OTHER PUBLICATIONS

European Search Report dated Apr. 18, 2016 in European Application 15184187, filed on Sep. 8, 2015 ( with English Translation of Categories of Cited Documents).

(Continued)

*Primary Examiner* — Vit W Miska
(74) *Attorney, Agent, or Firm* — Oblon, McClelland, Maier & Neustadt, L.L.P.

(57) ABSTRACT

A method of forming a decorative surface on a micromechanical timepiece part including a silicon-based substrate, including at least one step a) of forming pores (2) on the surface of the silicon-based substrate over a zone of the silicon-based substrate which corresponds to the decorative surface to be formed, the pores being designed to open out at the external surface of the micromechanical timepiece part. A micromechanical timepiece part including a silicon-based substrate, and having, over at least one zone of the silicon-based substrate, pores which are formed in the zone of the silicon-based substrate and open out at the external surface of the micromechanical timepiece part in order to form a decorative surface over the zone.

14 Claims, 1 Drawing Sheet

(51) Int. Cl.

| | |
|---|---|
| ***G04B 19/12*** | (2006.01) |
| ***G04B 45/00*** | (2006.01) |
| ***C25F 3/12*** | (2006.01) |
| ***C23C 30/00*** | (2006.01) |
| ***C23C 28/00*** | (2006.01) |

(52) U.S. Cl.
CPC ..... *C23C 30/00* (2013.01); *C25F 3/12* (2013.01); *G04B 19/12* (2013.01); *G04B 13/00* (2013.01); *G04B 13/02* (2013.01)

(58) Field of Classification Search
CPC ..... G04B 31/08; G04B 19/00; G04B 19/12; G04B 45/00; G04B 45/0076
See application file for complete search history.

(56) References Cited

U.S. PATENT DOCUMENTS 5,395,807 A * 3/1995 Divakar ..... C04B 35/565 264/44
5,441,799 A * 8/1995 Owens ..... C04B 38/00 277/404
7,926,355 B2 * 4/2011 Bannier ..... G04B 35/00 73/760
8,944,676 B2 * 2/2015 Conus ..... G04B 13/022 267/182
2006/0055097 A1 * 3/2006 Conus ..... G04B 17/066 267/273
2008/0112274 A1 * 5/2008 Bitterli ..... G04B 13/026 368/238
2008/0198702 A1 8/2008 Meister et al.
2010/0248449 A1 * 9/2010 Hildreth ..... B81C 1/00071 438/460
2012/0090933 A1 * 4/2012 Conus ..... G04B 13/022 188/371
2013/0286795 A1 * 10/2013 Conus ..... G04B 13/022 368/127

OTHER PUBLICATIONS

R.W. Tjerkstra et al. "Electrochemical Fabrication of Multi Walled Micro Channels", Micro Total Analysis Systems, Proceedings of the UTAS Workshop, XP-000874456, 1998, 4 pages.

* cited by examiner

METHOD OF FORMING A DECORATIVE SURFACE ON A MICROMECHANICAL TIMEPIECE PART AND SAID MICROMECHANICAL TIMEPIECE PART

This application claims priority from European Patent application 15184187.1 of Sep. 8, 2015, the entire disclosure of which is hereby incorporated herein by reference.

FIELD OF THE INVENTION

The present invention relates to a method for producing a decorative surface on a micromechanical timepiece part comprising a silicon-based substrate. The invention likewise relates to a micromechanical timepiece part comprising such a decorative surface which is able in particular to be obtained by such a process.

BACKGROUND OF THE INVENTION

Silicon is a material which is used more and more in the manufacture of micromechanical timepiece parts, in particular parts which remain connected to a silicon-based substrate on which they have been machined.

For example, silicon-based substrates can be used to produce dials.

The dials of watches or another timepiece part comprise inscriptions or decorative surfaces which make it possible to give information or to highlight the dial. These decorations are traditionally produced by different engraving techniques.

When the dial is produced with a silicon base, it is necessary to propose new techniques, in order to produce such inscriptions or decorative surfaces, which are easy to implement.

SUMMARY OF THE INVENTION

For this purpose, the present invention relates to a method for forming a decorative surface on a micromechanical timepiece part comprising a silicon-based substrate.

According to the invention, said method comprises at least one step a) of forming pores on the surface of said silicon-based substrate over a zone of the silicon-based substrate which corresponds to the decorative surface to be formed, said pores being designed to open out at the external surface of the micromechanical timepiece part.

The present invention likewise relates to a micromechanical timepiece part which is able to be obtained by the method as described above.

The present invention likewise relates to a micromechanical timepiece part comprising a silicon-based substrate and having, over at least one zone of said silicon-based substrate, pores which are formed in said zone of the silicon-based substrate and open out at the external surface of the micromechanical timepiece part in order to form a decorative surface over said zone.

The method according to the invention makes it possible to produce over the micromechanical timepiece part a porous silicon surface which is decorative and of a very dark colour, approaching black. A metallised coating applied over the porous silicon makes it possible to obtain a decorative surface of interferential colours.

BRIEF DESCRIPTION OF THE DRAWINGS

The aims, advantages and features of the present invention will appear more clearly in the following detailed description of at least one embodiment of the invention, given solely by way of non-limiting example and illustrated by the appended drawings in which.

DETAILED DESCRIPTION OF THE INVENTION

Figure 1:
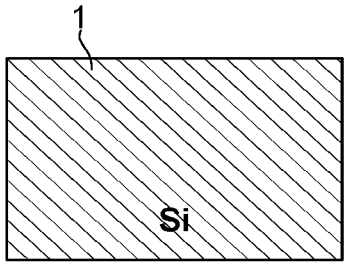
FIGS. 1 and 2 illustrate schematically the steps of a method according to the invention.
Figure 2:
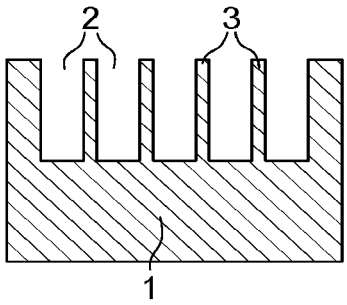

With reference to FIGS. 1 and 2, the method of forming a decorative surface on a micromechanical timepiece part comprising a silicon-based substrate 1 according to the invention comprises firstly a step a) of forming pores 2 starting from the surface of said silicon-based substrate 1 over a zone of the silicon-based substrate 1 which corresponds to the decorative surface to be formed. The pores 2 are designed so as to open out at the external surface of the micromechanical timepiece part, in order to form a surface which is visible for the user. The silicon-based substrate 1 is chosen as a function of the micromechanical timepiece part to be formed. The final shape of the silicon-based substrate, as a function of the micromechanical timepiece part to be manufactured, is given before or after implementation of the method of the invention. In the present invention, the expression «silicon-based substrate» describes both a layer of silicon in a substrate and a substrate made of silicon. Preferably, the silicon-based substrate 1 is a silicon wafer or an SOI wafer (Silicon-on-Insulator).

Advantageously, this step a) can be achieved by a method chosen from the group comprising a method by electrochemical etching, a method of the «Stain-etch» type and a method of the «MAC-Etch» type.

The method by electrochemical etching can be a method by electrochemical anodisation. The implementation thereof requires the use of an electrochemical bath containing hydrofluoric acid in aqueous solution or mixed with ethanol in concentrations of 1 to 10%. An electrical current and electrodes are necessary in order to create the electrochemical conditions causing the etching of the silicon. According to the electrochemical conditions, various types of pores can be obtained. Such a method is known to the person skilled in the art and does not require detailed information here.

The method of the «Stain-etch» type is based on a moist etching of silicon resulting directly in the formation of porous silicon. Typically, the attack takes place with an $HF/HNO_3/H_2O$ solution with an $HF:HNO_3$ ratio of 50-500:1. This method has the advantage of not requiring an electrical supply in the bath. Such a method is known to the person skilled in the art and does not require detailed information here.

Preferably, step a) is achieved by a method of the «MAC-Etch» type. This method is based on the use of particles of noble metals in order to catalyse local chemical etching reactions. Typically, a very thin layer (10-50 nm) of a noble metal (gold, silver, platinum) is deposited and structured in a random manner or by lift-off, etching, laser, etc. For preference, the noble metal is gold. More particularly, there can be used advantageously, particles of gold in solution in an HF/H2O2 mixture. The size of the particles can be between 5 and 1,000 nm. The structuring can be obtained by lithography of the gold, etching or lift-off. Another option is evaporation or cathodic pulverisation (sputtering) of a very fine, non-closed layer (5-30 nm). A thermal treatment will be able to contribute to the formation of islets of gold.

When the silicon with the layer of noble metal is immersed in an aqueous solution of an $HF/H_2O_2$ mixture, the noble metal locally catalyses the dissolution of the silicon. This etching solution can typically comprise between 4 ml:1 ml:8 ml (48% HF:30% $H_2O_2$:$H_2O$) and 4 ml:1 ml:40 ml (48% HF:30% $H_2O_2$:$H_2O$). The dissolution of the silicon is produced for preference under the metal, the latter penetrating then progressively into the silicon. This reaction can be continued over great depths (>100 μm) according to propagation modes essentially influenced by the orientation of the silicon crystal, the surface disposition, the doping and the chemistry of the bath. The method of the «MAC-Etch» type has the advantage of not requiring an electrical supply in the bath whilst allowing the formation of pores of very great depth (>100 μm) in the silicon. It is therefore particularly suitable for use with SOI wafers as substrate which are generally used for the manufacture of timepiece components.

The person skilled in the art knows the parameters of the methods described above which are to be implemented in order that the pores formed in the silicon-based substrate have a suitable geometry and size.

In particular, when assimilating the pores, in the plane of the timepiece part, with orifices of circular section, said pores can have preferably a diameter between 10 nm and 1,000 nm.

Advantageously, the pores can have a depth greater than 100 nm, preferably between 100 nm and 10 μm, and more preferably between 100 nm and 3 μm.

The suitable geometry and the size of the pores makes it possible to obtain a zone of porous silicon which has a very high power of light absorption, in the visible range in particular, and is antireflective. As a result, there is obtained a zone with very dark colour, substantially black. As illustrated in FIG. 2, the formation of pores 2 in the silicon-based substrate 1 over a certain depth causes the formation, between the pores 2, of silicon-based pillars 3 over the same depth. Preferably, when considering the silicon-based pillars as having a circular section, the pores 2 are formed such that the projected surface of the silicon-based pillars 3 is less than 79% of the total apparent surface in order not to have silicon-based pillars which are touching. The coloured zone which is obtained is used as decorative surface over the micromechanical timepiece part. By decorative surface, there is intended for example a design, a motif or an inscription, such as numbers or any other decoration.

The method according to the invention can optionally comprise, after step a), a second step b) consisting of depositing at least one coating over the decorative surface made of porous silicon which is obtained according to step a).

Advantageously, this coating deposited in step b) can comprise a metallisation layer based on at least one of the elements chosen from the group comprising Cr, Ti, Ag, Pt, Cu, Ni, Pd, Rh. Preferably, the metallisation layer is a fine layer, of a thickness less than 50 nm.

Advantageously, the coating deposited in step b) can likewise comprise a transparent oxide coating such as one of the oxides chosen from the group comprising $SiO_2$, $TiO_2$, $ZrO_2$, $HfO_2$, $Ta_2O_5$, $VO_2$ or mixtures thereof. The metallisation layer or the oxide layer can be used on its own, and be deposited for example directly over the porous Si, or the two layers can be combined, the oxide layer thus covering the metallisation layer. The thickness of the oxide layer is preferably between 100 nm and 2,000 nm.

Coating with a metallisation layer and with a transparent oxide layer over the decorative surface made of porous silicon makes it possible to obtain a decorative surface with interferential colours.

The method according to the invention can advantageously be implemented for the manufacture of silicon-based timepiece parts, such as dials.

The present invention likewise relates to a micromechanical timepiece part which is able to be obtained by the method as described above.

In particular, the present invention relates to a micromechanical timepiece part comprising a silicon-based substrate 1, and having, over at least one zone of said silicon-based substrate 1, pores 2 which are formed in said zone of the silicon-based substrate 1 and open out at the external surface of the micromechanical timepiece part in order to form a decorative surface over said zone, of a very dark colour, as described above.

According to another embodiment, the decorative surface of porous silicon is covered with a coating comprising a metallisation layer based on at least one of the elements chosen from the group comprising Cr, Ti, Ag, Pt, Cu, Ni, Pd, Rh.

According to another embodiment, the decorative surface of porous silicon is covered with a coating comprising a transparent oxide layer chosen from the group comprising $SiO_2$, $TiO_2$, $ZrO_2$, $HfO_2$, $Ta_2O_5$, $VO_2$.

Advantageously, the decorative surface of porous silicon is covered with a coating comprising the metallisation layer covered with the transparent oxide layer. This makes it possible to form a decorative surface with interferential colours.

What is claimed is:

1. A method of forming a decorative surface on a micromechanical timepiece part including a silicon-based substrate, said method comprising:

forming pores on the surface of said silicon-based substrate over a zone of the silicon-based substrate which corresponds to the decorative surface to be formed, said pores being designed to open out at an external surface of the micromechanical timepiece part, wherein said pores are assimilated, in the plane of the timepiece part, with orifices of circular section, and have a diameter between 10 nm and 1,000 nm and a depth greater than 100 nm.

2. The method according to claim 1, further comprising depositing at least one coating on the decorative surface, after forming the pores.

3. The method according to claim 2, wherein the coating includes a metallisation layer.

4. The method according to claim 2, wherein the coating includes a transparent oxide layer chosen from a group including SiO2, TiO2, ZrO2, HfO2, Ta2O5, and VO2.

5. The method according to claim 1, wherein the forming of pores is achieved by a method chosen from the group including a method by electrochemical etching, a method of a «Stain-etch» type and a method of a «Mac-Etch» type.

6. The method according to claim 5, wherein the forming of pores is achieved by the method of the «MAC-Etch» type.

7. The method according to claim 1, wherein the silicon-based substrate is a silicon wafer or an SIO wafer (Silicon-on-Insulator).

8. A micromechanical timepiece part obtained by the method according to claim 1.

9. The method according to claim 1, wherein the pores have a depth between 100 nm and 10 μm.

10. The method according to claim 1, wherein the pores have a depth between 100 nm and 3 μm.

11. The method according to claim 3, wherein the metallisation layer is a fine layer and a thickness of the metallisation layer is less than 50 nm.

12. The method according to claim 4, wherein the oxide layer has a thickness between 100 nm and 2,000 nm.

13. A micromechanical timepiece part comprising:

a silicon-based substrate; and pores formed in a zone of the silicon-based substrate, and open out at an external surface of the micromechanical timepiece part, forming a decorative surface over said zone, wherein said pores are assimilated, in the plane of the timepiece part, with orifices of circular section, and have a diameter between 10 nm and 1,000 nm and a depth greater than 100 nm.

14. The micromechanical timepiece part according to claim 13, wherein the decorative surface is covered by a coating including a metallisation layer and/or a transparent oxide layer chosen from a group including $SiO_2$, $TiO_2$, $ZrO_2$, $HfO_2$, $Ta_2O_5$, and $VO_2$.

* * * * *